United States Patent [19]

March

[11] Patent Number: 4,830,365

[45] Date of Patent: May 16, 1989

[54] HOME FITNESS GYM

[76] Inventor: Craig J. March, 32841 Parklane, Garden City, Mich. 48135

[21] Appl. No.: 84,201

[22] Filed: Aug. 12, 1987

[51] Int. Cl.[4] ..... A63B 21/04

[52] U.S. Cl. ..... 272/136; 272/142

[58] Field of Search ..... 272/136, 900, 145, 116, 272/135, 142, 118, 141; 177/232, 233

[56] References Cited

U.S. PATENT DOCUMENTS

| | | | |
|---|---|---|---|
| Re. 14,618 | 3/1919 | Chanaud | 272/142 X |
| 679,784 | 8/1901 | Ryan | 272/900 X |
| 799,270 | 11/1904 | Roland | 272/141 X |
| 1,626,976 | 5/1927 | Schoof | 177/233 X |
| 2,825,224 | 3/1958 | Lindenauer et al. | 272/135 X |
| 3,248,107 | 4/1966 | Wolski et al. | 272/141 |
| 3,329,428 | 7/1967 | Moran | 272/142 X |
| 3,428,312 | 2/1969 | Machen | 272/142 X |
| 3,784,195 | 1/1974 | Johnson | 272/141 X |
| 4,351,527 | 9/1982 | Crisp | 272/141 X |
| 4,384,715 | 5/1983 | Savio et al. | 272/136 |
| 4,603,857 | 8/1986 | Chipman et al. | 272/142 X |

OTHER PUBLICATIONS

"Ultra Shaper"; Am. Express Merch. Cat.; 10/1986, p. 44.

*Primary Examiner*—Richard J. Apley
*Assistant Examiner*—H. Flaxman
*Attorney, Agent, or Firm*—Richard C. Litman

[57] ABSTRACT

This device relates to exercising equipment having a vertical tubular containment housing with means for attachment to a mounting surface. Said vertical tubular containment housing has an upper terminal end cap with a fastening device for disposing a spring longitudinally within said vertical tubular containment housing. A molded piston assembly is slidably disposed with the vertical tubular containment housing and has a fastening device for securing the lower end of the spring, said molded piston assembly having a fastening device for securing a rope thereto such that as the rope is pulled, said spring is distended a distance longitudinally downward within said vertical tubular containment housing. Said rope having attachment and mechanical structure for permitting a wide variety of excercising routines.

8 Claims, 3 Drawing Sheets

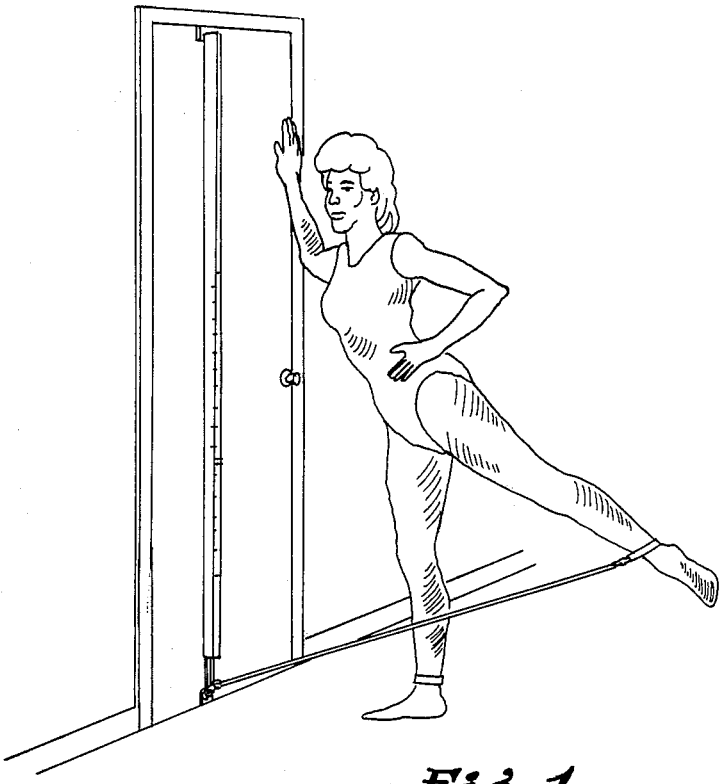
Fig. 1
Fig. 3
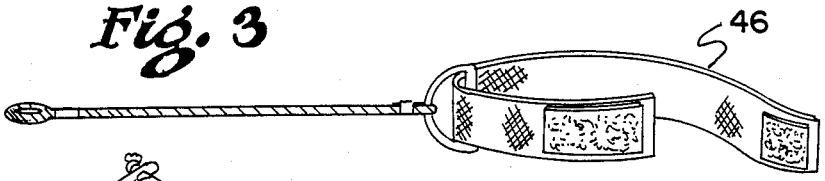
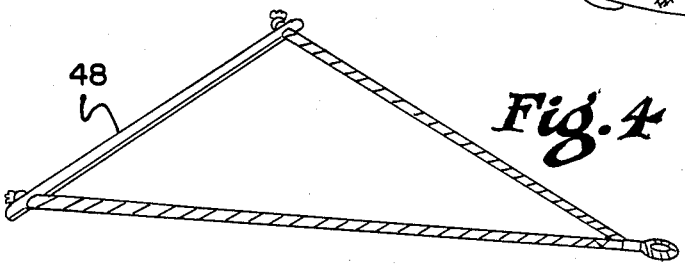
Fig. 4
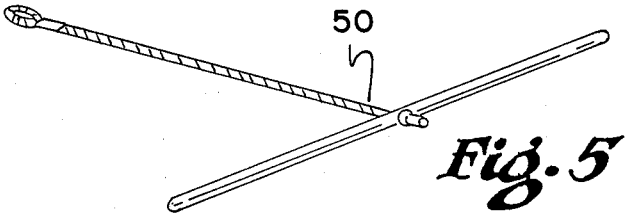
Fig. 5

HOME FITNESS GYM

BACKGROUND TO THE INVENTION

Exercising devices have been prevalent for a number of years. Many such devices, patented and unpatented, affix to walls or doors with the object that the individual be able to perform an exercising routine. These devices have as their primary objective the operation of the device such that the individual may improve his or her general state of health.

As a general rule those exercising devices that are truly portable, as opposed to those requiring bulky handling and storage, typically do nothing to prevent damage to the walls or door on which they are mounted.

Thus, with most of these portable devices that are easily attached or detached from a supporting surface such as a wall or door, the most vigorous exercises cannot actually be done due to the risk of damaging the supporting surface as the active mechanism of the device springs back or retracts if the handles are quickly released.

Potential damage to the supporting surface of the device is, however, only one facet of a larger problem typical with many portable exercising devices. This larger problem is not only the lack of a construction preventing damage to the supporting surface, but lack of a construction that serves to ensure the safety of the individual using the equipment.

Many such devices use springs or elastic cords that, if suddenly released, as, for example, if the individual has a cramp while using the equipment, will spring back against the supporting surface, often pulling the hand or arm of the individual with it. Such sudden dislocations and bruises thus suffered are rarely fatal, but are often painful.

DESCRIPTION OF THE PRIOR ART

Exercising devices wherein a handle attachment is connected to a cable for displacement against the bias of a spring mechanism or elastic cord is well-known in the prior art. Representative of such devices are disclosed in the following patents

| U.S. Pat. No. | Inventor |
|---|---|
| 679,784 | Ryan, M.B. |
| 689,418 | Ryan, M.B. |
| 680,556 | Wieland |
| 4,060,240 | Dunston |
| 775,989 | Roberts |

U.S. Pat. No. 679,784 to M. B. Ryan discloses a door-attached device utilizng elastic cords and a set of pulleys. When handle grips are pulled outward and upward, a rope-pulley arrangement draws upward against a set of elastic cords, thus providing tension.

Neither this invention nor another issued to Ryan, U.S. Pat. No. 689,418 disclose any construction that confines the device within a bounded area to safeguard the door, wall or other supporting surfaces.

U.S. Pat. No. 680,556 to Wieland discloses a stretched band which may be mounted to a door. A slidable buckle is attached to this band by which a rope and handle apparatus attached to the buckle may be vertically moved up and down the band. This device discloses no construction for protecting either door or individual from scraps or the banging of either the buckle or the rope and handles against the supporting surface.

U.S. Pat. No. 4,060,240 to Dunston discloses a pulley pivotably fixed to a cross-strap. Ropes pass through the pulley and connect to dual hand-holds. The connection on one side of the rope, before the rope enters one of the hand-holds, is a rope takeup component that checks or inhibits rope travel when tension is applied. This device essentially enables the exerciser to work against himself or herself, but only in the most limiting fashion. Again, there is no construction in this device for protecting the surface finish of a door or other supporting surface.

U.S. Pat. No. 775,989 to Roberts discloses a device for exercising that utilizes elastic straps attached to a mounting bracket. This bracket can be inserted between a door and jamb. It contains neither construction to contain the apparatus against damage to any supporting surface, nor to limit the force by which the handles retract into a housing or other containment.

None of the prior art, singularly or collectively, provides or teaches a construction for a portable device that safeguards both supporting surfaces and the individual using the equipment.

SUMMARY OF THE INVENTION

This invention relates to exercising devices and especially to those exercising devices and apparatuses that are typically used in the home. More particularly, this device relates to that category of home use equipment that is intended to be temporary in its installation on any suitable mounting surface such as the back of a door and the like.

An object of this invention is to provide a device that may be easily attached and detached from any suitable supporting surface, such as a door or wall.

Another object of the present device is to provide an apparatus for exercising in the home that protects the supporting surface to which it is attached from damage, caused by handles or straps suddenly extending backward or the force of the apparatus itself impacting against the mounting surface.

A further object of the present device is to automatically provide a device adjustment, reacting to the force applied by the user of the equipment, thus being suitable for men, women and children, all of whom can use the device with equal facility and benefit.

A further object of this invention is to provide a device safe to use, such that a sudden release of the handle or strap does not result in a quick or abrupt pulling against either the apparatus or the individual user.

DESCRIPTION OF THE DRAWINGS

FIG. 1 is a view of the device in use in a typical home arrangement.

FIG. 3 illustrates a typical construction of an ankle or wrist band.

FIG. 4 illustrates a different or alternative handle.

FIG. 5 illustrates alternative holding means.

DESCRIPTION OF THE PREFERRED EMBODIMENT

Figure 2:
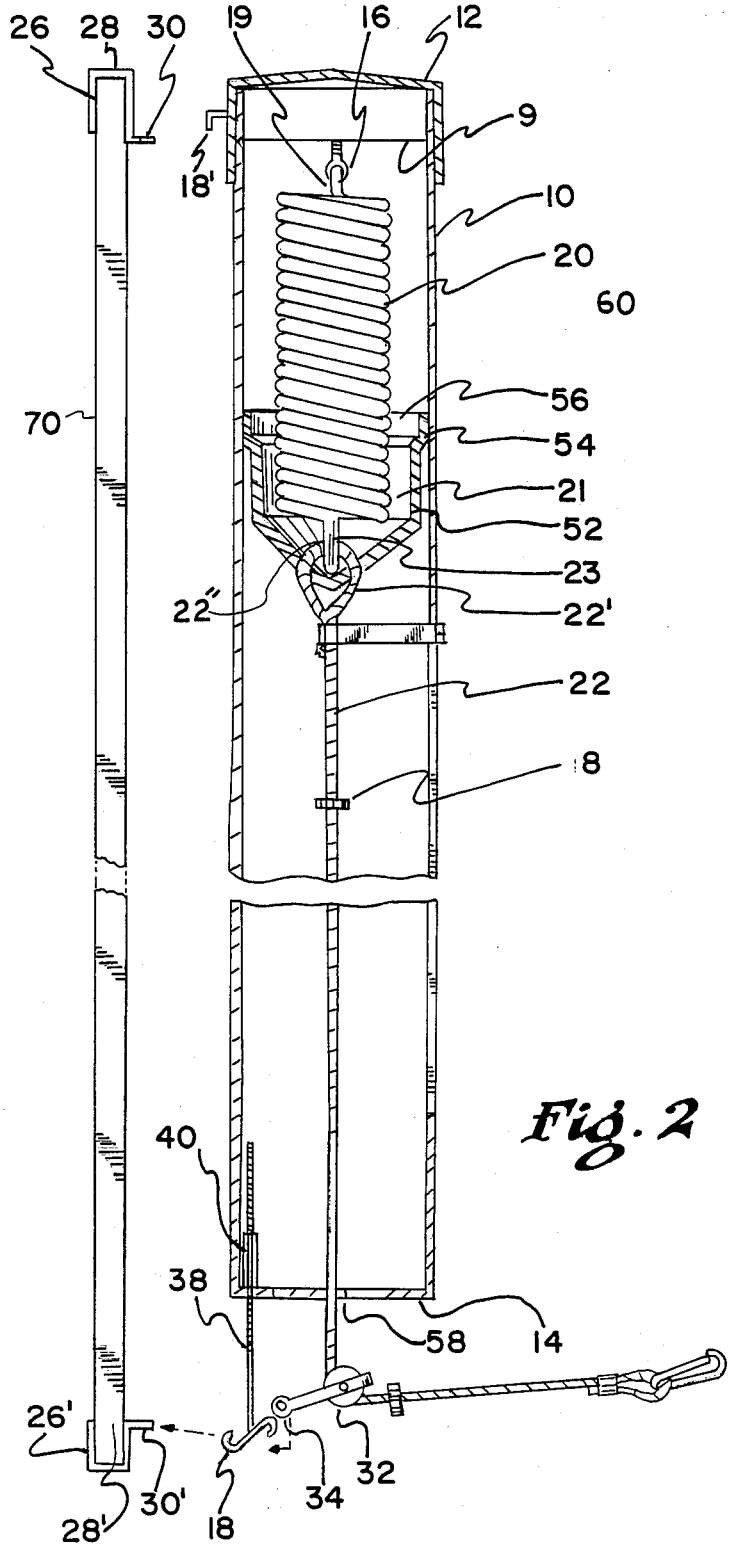
FIG. 2 is a sectional view generally showing the arrangment of the parts.

Referring now to FIGS. 1 through 7, device 60 consists of a vertical tubular housing 10, containing the operating parts of the apparatus. Specifically, the vertical tubular housing 10 includes a first terminal cap 12 and a second terminal cap 14 which comprises a concentrically positioned orifice 58. Vertical tubular housing 10 further includes terminally disposed exterior fastening means for reversible attachment to an upper end section 28 and a lower end section 28' of a mounting surface. Preferably, the terminally disposed exterior fastening means consists of a hook component 18' permanently affixed to first terminal cap 12 along its vertical periphery and a S-hook or double-hook component 18 permanently affixed to rod 38 which extends vertically from and affixes adjustably to second terminal cap 14 along its horizontal section by fastening means as shown in FIG. 2. The upper end section 28 and the lower end section 28' of the mounting surface preferably include brackets 26 and 26' secured to door 70. Each bracket consists of a horizontally disposed flange component 30 and 30' containing a vertically disposed orifice (not shown) which is adapted to engage either hook component 18' or a single hook of double-hook component 18.

A plug 9 is tightly fitted within vertical tubular housing 10 proximate to first terminal cap 12. This plug may be constructed of any durable material, such as metal. Eyebolt 16 is secured at the center of plug 9.

Spring 20 is longitudinally aligned within vertical tubular housing 10 and has a first axial end 19 end affixed to eyebolt 16 and a second axial end 23 affixed to conically molded piston assembly 21. Molded piston assembly 21 centers second axial end 23 of spring 20 along a centerline substantively comprising the longitudinal axis of tubular containment housing 10. Molded piston assembly 21 may be constructed of any suitable material such as rubberized compounds.

Spring 20 is seated with concave surface 52 and may be permanently bonded thereto. Molded piston assembly 21 has a circular base 56 disposed along its upper circumference such that it allows the longitudinal movement; the stretching and contraction of spring 20 within the confines of tubular containment housing 10, without interference from the interior surfaces of the vertical tubular containment housing 10. Concave surface 52 functions to keep spring 20 centered in the vertical tubular containment housing 10.

Circular base 56 has a raised rib or ridge 54 which biases conically molded piston assembly 21 against the interior of vertical tubular containment housing 10, thus providing a smooth working surface contiguous thereto, which allows conically molded piston assembly 21 to be disposed upwardly and downwardly longitudinally within vertical containment housing 10, thereby imparting compression to that movement. Circular base 56 being slidably disposed to the interior surfaces of vertical tubular containment housing 10 and encounters compression as molded piston assembly 21 is displaced longitudinally within the housing 10.

Molded piston assembly 21 has fastening means, such as bores 22" and 22', which are substantially normal to second axial end 23 of spring 20, allowing a rope 22 to be attached to the vertex of conically molded piston assembly 21. One end of rope 22 passes through bores 22' and 22" and an opening in said second axial end 23 of spring 20 and is secured together along its vertical axis by fastening means. As rope 22 extends longitudinally downward, molded piston assembly 21 is displaced equally downward within the housing 10. The other end of rope 22 contains stop means 8 secured along its vertical axis for engagement with second terminal cap 14 to prevent displacement of the rope beyond concentrically positioned orifice 58.

Rope 22 extends through orifice 58 and engages pulley 32 which is pivotally mounted externally of vertical tubular housing 10 and substantially aligned with concentrically positioned orifice 58 in second terminal cap 14 by pivotable fastening means. Suitable pivotable fastening means includes eyelet 34 which is permanently mounted on pulley 32, and removably engages the remaining hook of S-hook or double-hook component 18 whereby pulley 32 may be turned at any angle to the vertical tubular containment housing 10, thereby allowing freedom of movement of the individual utilizing the device. Thus, free and unfettered operation of the apparatus is allowed to take place.

As shown in FIG. 2, adjustable means for fastening rod 38 to second terminal cap 14 preferably includes sleeve 40 which is permanently affixed to the interior of vertical tubular housing 10. Rod 38 may be constructed of steel and is threaded to be adjustably screwed into sleeve 40.

Rope 22 extends out through pulley 32 and connects to handle means comprising leg strap attachment 46, dual-line handle attachment 48 and single-line handle attachment 50 as indicated in FIGS. 3, 4, 5.

Figure 6:
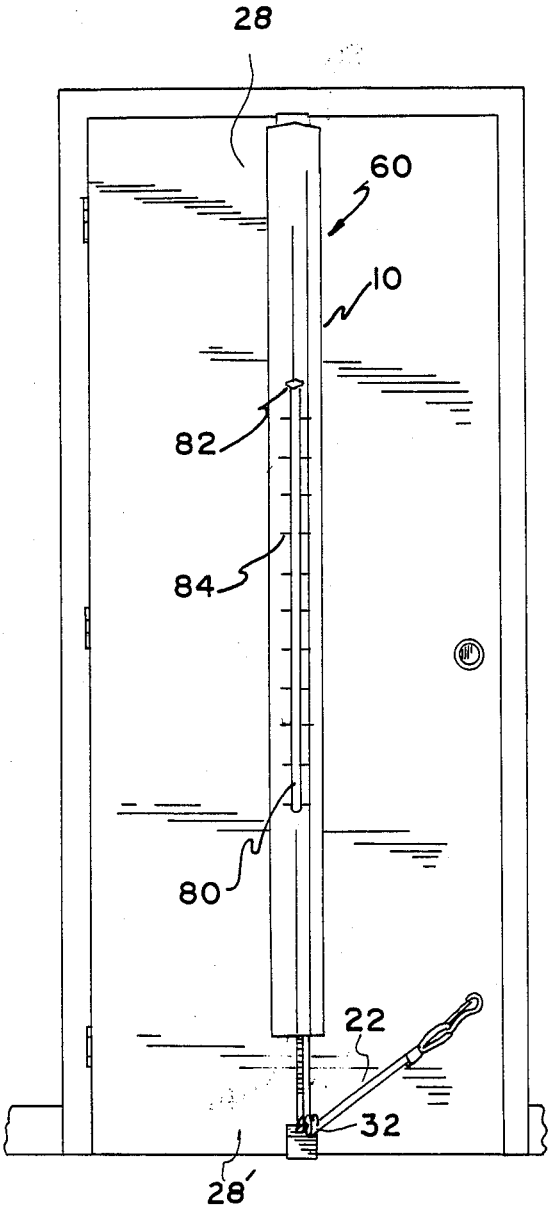
FIG. 6 is an elevational view indicating the relative size of the device in comparsion to a typical residential door. In this device the arrangement is oriented for exercises having to do with the feet or ankles, the handle being placed in a downward disposition.

Referring to FIG. 6, the exercising apparatus is affixed to a mounting surface in the same orientation as shown in FIG. 1; the rope 22 extends from pulley 32 situated at lower end section 28' of a mounting surface.

Figure 7:
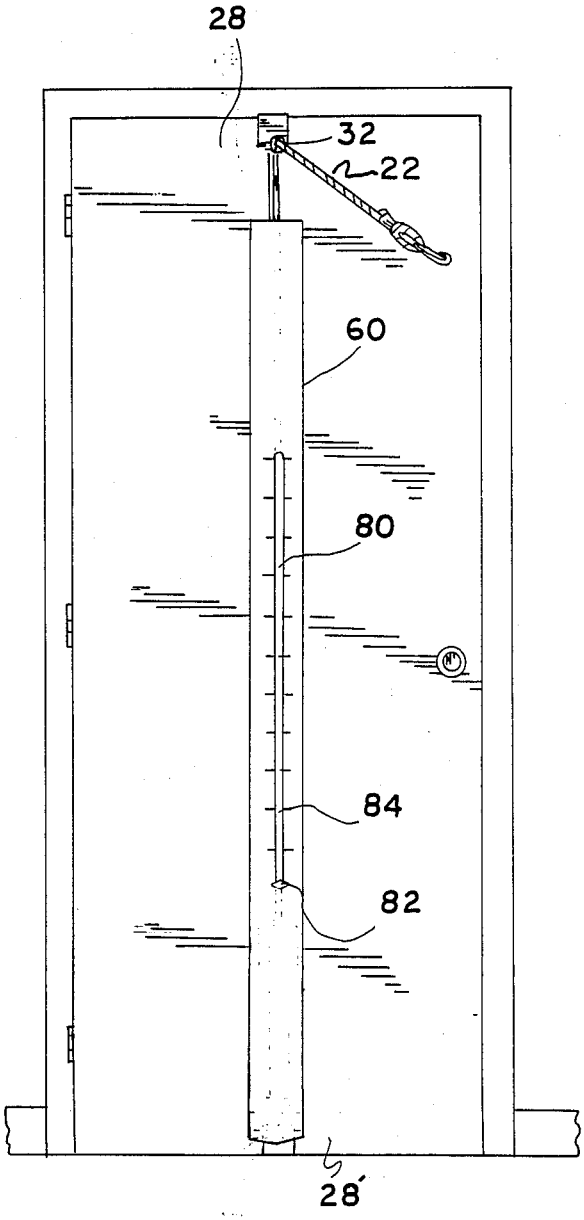
FIG. 7 shows the device up-ended with the handle means overhead for the execution of an entirely different set of exercising routines.

FIG. 7 illustrates exercising apparatus 60 orientated in the reverse of that shown in FIG. 6, wherein rope 22 extends from pulley 32 situated at upper end section 28 of a mounting surface. This reversibility feature of the present invention permits the user to accomplish a variety of different exercising routines.

FIGS. 6 and 7 illustrate an alternative embodiment for registering the exercising force consisting of indicating means. Specifically, indicator 82 connects internally to rope 22 along its vertical axis by fastening means and projects from vertical tubular housing 10 through guide slot 80. Guide slot 80 extends vertically along the length of the tubular housing. Graduation markings 84 extend parallel to guide slot 80 and are displayed externally on vertical tubular housing 10. The graduation markings, calibrated in any suitable units, provide the user an accurate visual indication of the exercising force developed in response to the displacement of the rope against the bias of the spring.

Thus it will be understood that the present exercising apparatus is so constructed to provide varying resistance encountered by the user. Also, dozens of exercises for the upper and lower body of the user can be accomplished. Further, it will be appreciated that the compression of a the conically molded piston assembly against the interior surface of the tubular housing prevents the rapid retraction of the spring when the tension on the rope is suddenly or accidentally released.

It should be understood that various changes and modification can be made of the disclosure without departing from the spirit and scope of the invention. Accordingly, the foregoing illustrations are not to be interpreted as restrictive of the invention beyond that necessitated by the following claims.

What is claimed is:

1. An exercising apparatus comprising:

a vertical tubular housing including a first terminal cap and a second terminal cap and having exterior mounting means terminally disposed for reversible attachment to an upper end section and a lower end section of a mounting surface, said second terminal cap including a concentrically positioned orifice;

a plug tightly fitted within said vertical tubular housing and positioned proximate to said first terminal cap;

a spring longitudinally aligned within said vertical tubular housing having opposite axial ends consisting of a first axial end and a second axial end, said first axial end secured to said plug by fastening means;

said second axial end provided with an opening;

a conically molded piston assembly longitudinally aligned within said vertical tubular housing adapted to center said spring and having a circular base including a raised rib contiguous with and biased against the interior surface of said vertical tubular housing and an opposite vertex comprising a bore substantially normal to said second axial end of the spring;

a pulley pivotally mounted externally of said vertical tubular housing adjacent said exterior mounting means and substantially aligned with said concentrically positioned orifice in said second terminal cap;

a rope having one end passing through both said bore of said conically molded piston assembly and said opening in said second axial end of said spring and secured together along its vertical axis by fastening means; and said rope having another end extending longitudinally through said concentrically positioned orifice, engaging said pulley and connecting to handle means for transmitting an exercising force developed in response to the displacement of said rope against the bias of said spring.

2. The exercising apparatus according to claim 1, wherein said exterior mounting means for reversible attachmemt to said upper end section and a lower end section of the mounting surface comprises:

a hook component permanently affixed to said first terminal cap along its vertical periphery; and a double-hook component permanently affixed to a rod vertically extending from and adjustably affixed to said second terminal cap along its horizontal section by fastening means.

3. The exercising apparatus according to claim 2, wherein said upper end section and said lower end section of the mounting surface includes brackets secured to said mounting surface, and wherein said brackets comprise a horizontally disposed flange component containing a vertically disposed orifice adapted to engage either said hook component or a single hook of said double-hook component.

4. The exercising apparatus according to claim 3, wherein said double-hook component includes a retaining hook pivotally fastened to an eyelet securely affixed to said pulley.

5. The exercising apparatus according to claim 1 wherein said handle means is selected from the group consisting of a leg strap attachment, a dual-line handle attachment and a single-line handle attachment.

6. The exercising apparatus according to claim 1, including indicating means for registering the exercising force, wherein said indicating means comprise:

an indicator internally connected to said rope along its vertical axis by fastening means and projecting from said vertical tubular housing through a guide slot extending vertically; and graduation markings vertically extending the length of said guide slot displayed externally on the tubular housing parallel to said guide slot.

7. The exercising apparatus according to claim 1, including stop means secured to said rope along its vertical axis within said vertical tubular housing for engagement with said second terminal cap to prevent displacement of the rope beyond said concentrically positioned orifice.

8. The exercising apparatus according to claim 1, wherein said conically molded piston assembly is constructed of a rubberized material.

* * * * *